US007837317B2

(12) United States Patent
Gold et al.

(10) Patent No.: US 7,837,317 B2
(45) Date of Patent: Nov. 23, 2010

(54) SOLID INK STICK WITH WITNESS MARK

(75) Inventors: Christopher Ryan Gold, Tigard, OR (US); Barry D. Reeves, Lake Oswego, OR (US); William Loren Emery, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 168 days.

(21) Appl. No.: 12/031,964

(22) Filed: Feb. 15, 2008

(65) Prior Publication Data

US 2009/0207220 A1 Aug. 20, 2009

(51) Int. Cl.
*B41J 2/175* (2006.01)

(52) U.S. Cl. ..... 347/99; 347/88

(58) Field of Classification Search ..... 347/88, 347/99

See application file for complete search history.

(56) References Cited

U.S. PATENT DOCUMENTS

| | | | | |
|---|---|---|---|---|
| 3,722,240 | A | 3/1973 | Spain et al. | |
| 6,761,444 | B2 | 7/2004 | Jones et al. | |
| 6,857,732 | B2 | 2/2005 | Jones et al. | |
| D505,973 | S * | 6/2005 | Jones et al. | D18/56 |
| 6,986,570 | B2 | 1/2006 | Jones et al. | |
| 2003/0202056 | A1* | 10/2003 | Jones et al. | 347/85 |
| 2003/0202071 | A1* | 10/2003 | Jones et al. | 347/88 |
| 2003/0202074 | A1 | 10/2003 | Jones | |
| 2003/0202076 | A1* | 10/2003 | Jones et al. | 347/99 |
| 2008/0122913 | A1 | 5/2008 | Jones et al. | |

FOREIGN PATENT DOCUMENTS

| | | |
|---|---|---|
| EP | 1359014 A1 | 11/2003 |
| EP | 1359023 A | 11/2003 |
| EP | 1359024 A1 | 11/2003 |
| EP | 1731309 A2 | 12/2006 |

OTHER PUBLICATIONS

EP Search Report, European Patent Office, Munich, Germany, May 6, 2009.

Non-Final Office Action for U.S. Appl. No. 12/139,636, mailed Oct. 5, 2009, United States Patent and Trademark Office (9 pages).

Amendment in Response to Non-Final Office Action for U.S. Appl. No. 12/139,636, submitted Jan. 5, 2010 (10 pages).

Final Office Action for U.S. Appl. No. 12/139,636, mailed Apr. 13, 2010, United States Patent and Trademark Office (12 pages).

Amendment accompanying a Request for Continued Examination for U.S. Appl. No. 12/139,636, submitted Jul. 13, 2010 (9 pages).

* cited by examiner

*Primary Examiner*—Matthew Luu
*Assistant Examiner*—Rut Patel
(74) *Attorney, Agent, or Firm*—Maginot, Moore & Beck LLP

(57) ABSTRACT

A solid ink stick comprises an ink stick body having a top surface, a bottom surface, and a plurality of side surfaces extending between the top and bottom surfaces. The plurality of side surfaces defines a perimeter of the ink stick body. At least one key contour is formed in at least one side surface in the plurality of side surfaces extending at least partially between the top surface and the bottom surface. A witness mark is formed along at least a portion of the perimeter of the ink stick body with a portion of the witness mark following the at least one key contour.

13 Claims, 7 Drawing Sheets

SOLID INK STICK WITH WITNESS MARK

TECHNICAL FIELD

This disclosure relates generally to phase change ink jet printers and the solid ink sticks used in such ink jet printers.

BACKGROUND

Solid ink or phase change ink printers conventionally receive marking material in a form known as an ink stick. The ink stick is a solid or semi-solid structure that may have any convenient shape (e.g., a pellet, block, brick, cube, or any other geometric structure) for handling and loading into the printer. During use, ink sticks are inserted through an insertion opening of an ink loader for the printer and pushed or slid along a feed channel by a feed mechanism and/or gravity toward an ink melting assembly in the printer. The ink melting assembly melts the solid ink stick into a liquid that is delivered to a print head for jetting onto a recording medium.

One difficulty faced in solid ink technology is identification and authentication of ink sticks to ensure the correct loading and compatibility of an ink stick with the imaging device in which it is used. For example, unlike powdered or liquid marking materials, the solid form of ink sticks allows the ink sticks to be handled and loaded into a phase change ink printer without the need for a container or cartridge, as is typically required for liquid ink or powdered toner. In addition, the entire ink stick may be melted and consumed, with no need to dispose of, or recycle, any container. Eliminating the need for a container provides many advantages to the use of ink sticks. Containers or cartridges, however, may be provided with electronic tags, barcodes, etc. that may be used to identify and/or authenticate the ink contained therein. Without the use of a container, the mechanisms for authenticating or otherwise identifying the ink stick may be limited.

Provisions have been made to facilitate the authentication and/or identification of ink sticks so that ink sticks are correctly loaded into the intended feed channel and to ensure that the ink sticks are compatible with the printer in which they are used. One provision is generally directed toward excluding wrong colored or incompatible ink sticks from being inserted into the feed channels of the printer. For example, the correct loading of ink sticks has been accomplished by incorporating keying features into the exterior surface of an ink stick. These features are protuberances or indentations that are located in different positions on an ink stick. For example, FIG. 9 shows an embodiment of an ink stick 2 that includes a keying feature 4 that is in the form of a notch that extends along a side surface of the ink stick. Corresponding key elements 6 are positioned on the perimeter of the opening 8 through which the ink stick 2 is inserted. An ink stick that does not have the appropriate key elements in the correct position for the particular insertion opening is excluded from insertion.

While the use of keying features on ink sticks may be effective in ensuring that ink sticks are correctly loaded and compatible with the printer in which they are used, the use of keying features is limited in that the "authentication" of the ink stick cannot be done without access to the printer to see if the keying features on the ink stick match the keying features of the ink loader. In addition, in order to be effective in excluding ink sticks, the key elements are relatively large. Due to the soft, waxy nature of the ink stick body, key features, such as the key feature of FIG. 3, may be casually or easily modified or added to an existing ink stick by milling, cutting, melting and reforming, or otherwise removing material in a shape complementary to keying shapes incorporated into insertion openings. Visual inspections of the ink stick thereafter may be incapable of detecting such a modification.

In addition, world markets have created a situation where ink sticks may be sold under different marketing programs at various price points. Thus, ink sticks having substantially the same configuration may be sold in different markets at different prices. The identification and/or authentication of Ink sticks intended for sale in different markets and/or at different prices has been accomplished by incorporating different keying features into the ink sticks. Selling ink sticks at different prices in different markets, however, offers the undesired opportunity for enterprising entities to purchase ink sticks at a lower price in one market, modifying the ink sticks to include the keying features of ink sticks sold in a different market and/or at a different price point, and reselling the modified ink sticks in the different market at a higher price for monetary gain. Such behavior, described as arbitrage, can cost a company a significant amount of money in lost revenue and profit. Additionally, this can be very harmful and disruptive to legitimate distributors and resellers.

SUMMARY

A solid ink stick is provided that includes a witness mark for providing a visual indication of whether an ink stick has been casually modified from its original or manufactured form. In particular, the ink stick comprises an ink stick body having a top surface, a bottom surface and a plurality of side surfaces extending between the top and bottom surfaces. The plurality of side surfaces defines a perimeter of the ink stick body. At least one key contour is formed in at least one side surface in the plurality of side surfaces extending at least partially between the top surface and the bottom surface. A witness mark is formed along at least a portion of the perimeter of the ink stick body with a portion of the witness mark following the at least one key contour.

In another embodiment, an ink stick for use in an ink loader of a phase change ink imaging device comprises an ink stick body configured for insertion in an insertion direction into an ink loader of a phase change ink imaging device. The ink stick body includes a top surface, a bottom surface and a plurality of side surfaces extending between the top and bottom surfaces. The bottom surface of the ink stick body is for entering the ink loader first and the top surface is for entering the ink loader last when the ink stick body is inserted into the ink loader in the insertion direction. The ink stick body includes an insertion perimeter encompassing outermost portions of the surfaces of the ink stick body relative to the insertion direction. At least one key contour is formed in the insertion perimeter of the ink stick body. The at least one key contour extends at least partially along at least one surface in a direction substantially parallel to the insertion direction. A witness mark is formed in the insertion perimeter extending substantially continuously along the insertion perimeter of the ink stick body transverse to the insertion direction with a portion of the witness mark following the at least one key element contour.

In yet another embodiment, a method of manufacturing an ink stick is provided. The method comprises fabricating an ink stick having a top surface, a bottom surface and a plurality of side surfaces extending between the top and bottom surfaces. The plurality of side surfaces defines a perimeter of the ink stick body. At least one key contour is formed in at least one surface in the plurality of side surfaces extending at least partially between the top surface and the bottom surface. A witness mark is then formed along at least a portion of the perimeter of the ink stick body with a portion of the witness mark following the at least one key contour.

DETAILED DESCRIPTION OF THE PREFERRED EMBODIMENT

Figure 1:
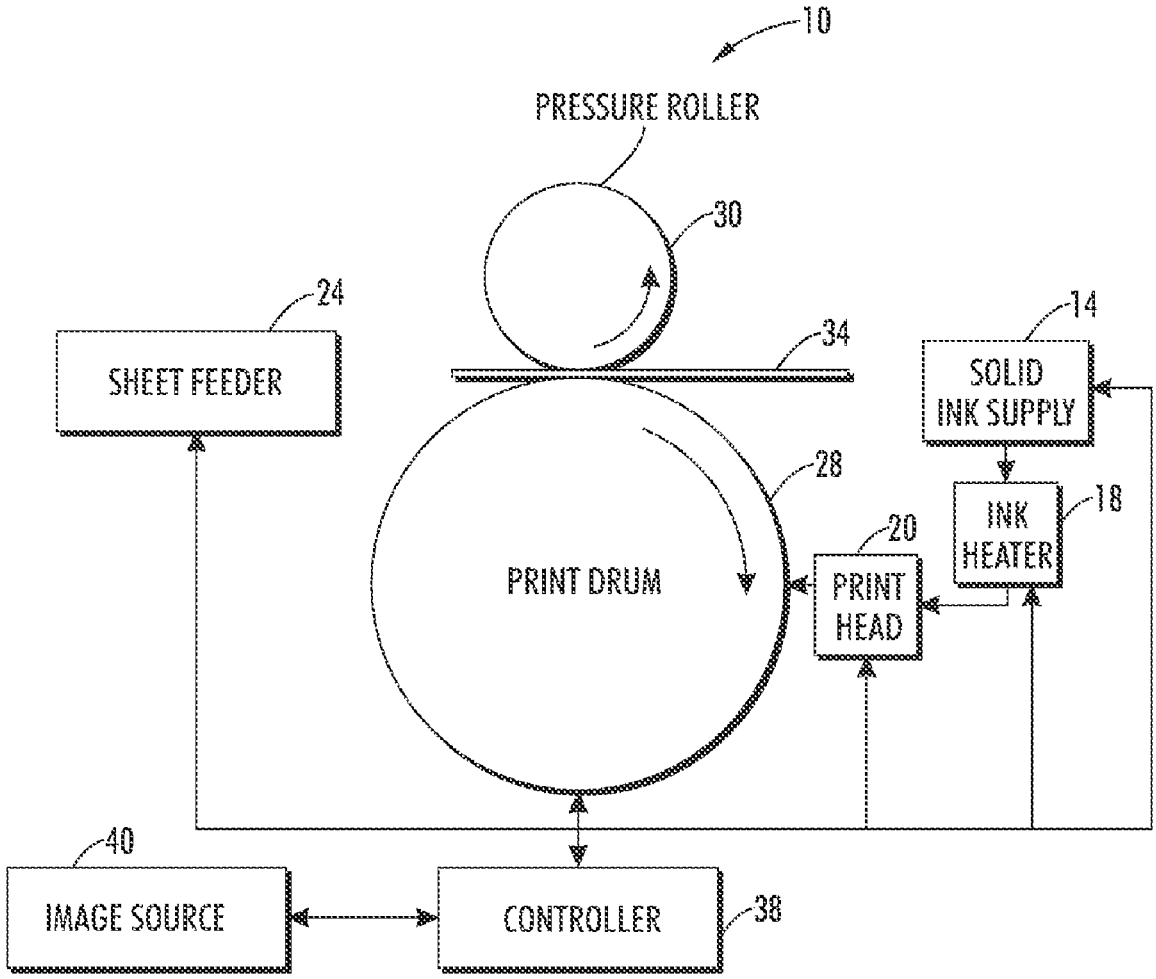
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present invention.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling many or all of the other machine subsystems and functions, including the machine's printing operations, and, thus, includes the necessary hardware, software, etc. for controlling these various systems.

Figure 2:
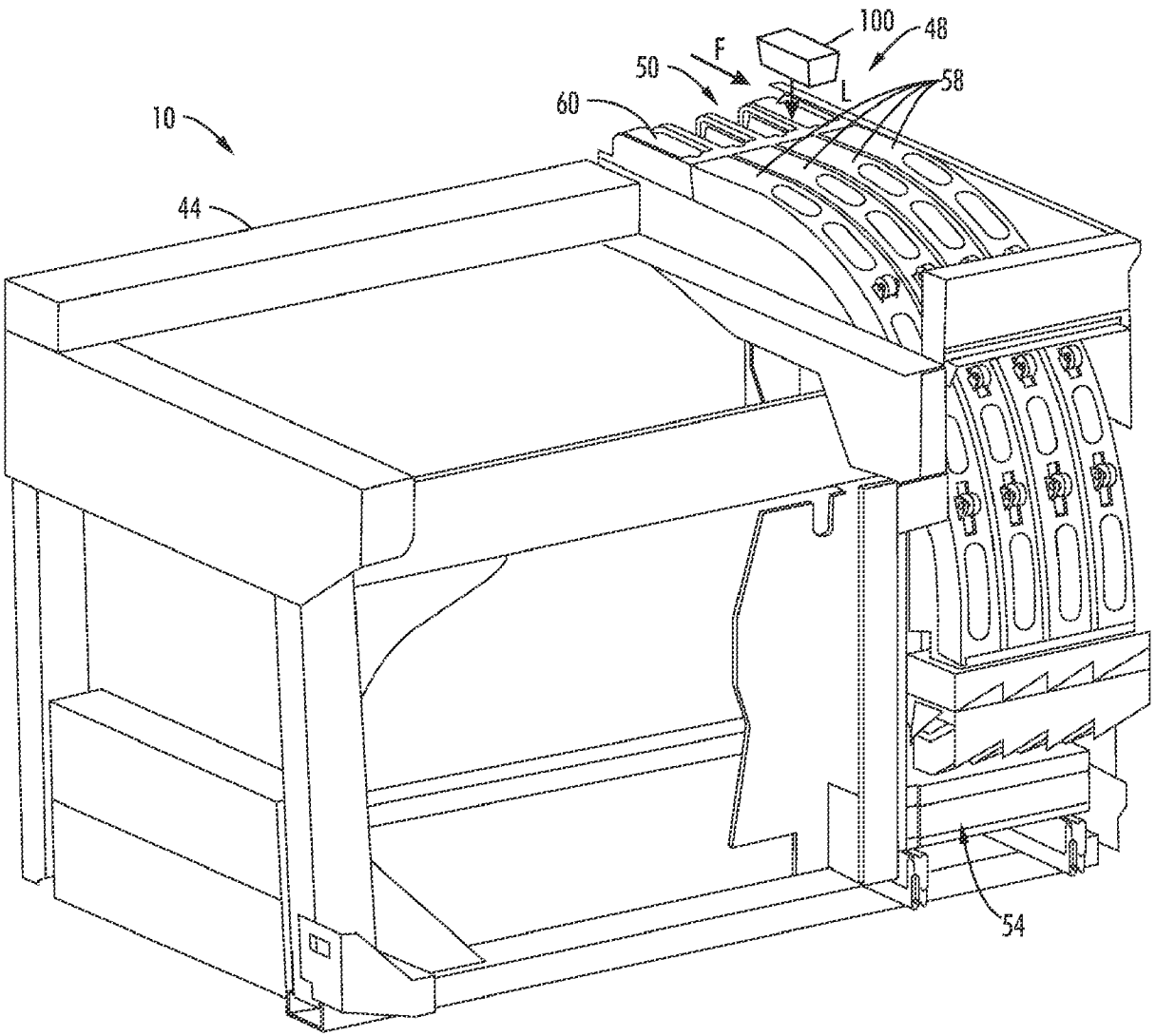
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

In the embodiment of FIG. 2, the loading station receives ink sticks inserted through the keyed openings 60 in an insertion direction L. The feed channels are configured to transport ink sticks in a feed direction F from the loading station to the melting station. In the embodiment of FIG. 2, the insertion and feed directions L, F are different. For example, ink sticks may be inserted in the insertion direction L and then moved along the feed channel in the feed direction F. In an alternative embodiment, the feed channels and keyed openings may be oriented such that the insertion and feed directions L, F are substantially parallel.

Figure 3:
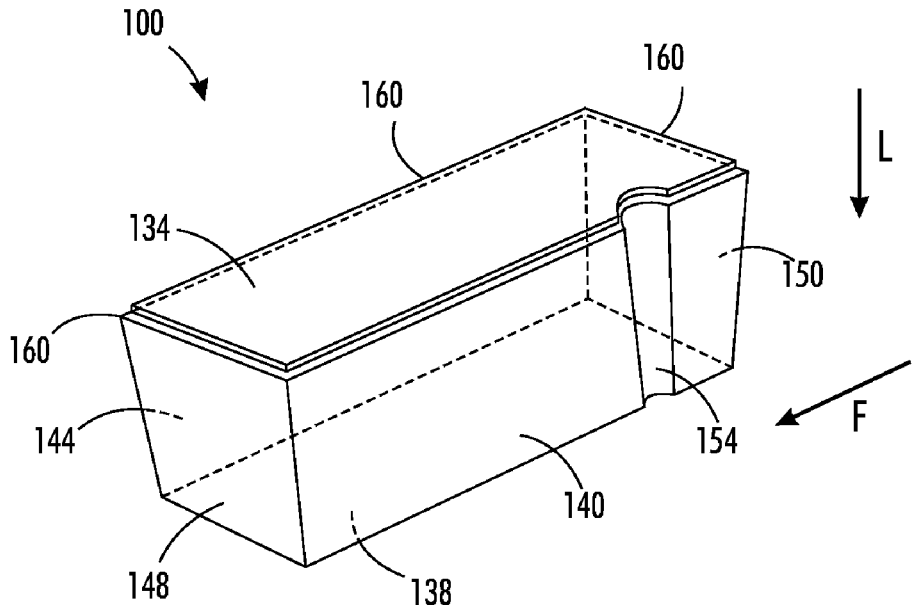
FIG. 3 is a perspective view of one embodiment of a solid ink stick that includes a witness mark.

An ink stick may take many forms. One exemplary solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Ink sticks may include a number of features that aid in correct loading, guidance, sensing and support of the ink stick when used. These loading features may comprise protrusions and/or indentations that are located in different positions on an ink stick for interacting with key elements, guides, supports, sensors, etc. located in complementary positions in the ink delivery system. Loading features may be categorized as insertion features or feeding features. Insertion features such as exclusionary keying elements and orientation elements are configured to facilitate correct insertion of ink sticks into the loading station and, as such, are substantially aligned with the insertion direction L of the loading station. As an example, the ink stick of FIG. 3 includes an insertion keying feature 154. The insertion keying feature is configured to interact with the keyed openings 60 of the loading station 50 to admit or block insertion of the ink sticks through the insertion opening 60 of the solid ink delivery system. In the ink stick embodiment of FIG. 3, the key element 154 is a vertical recess or notch formed in side surface 140 of the ink stick body substantially parallel to the insertion direction L of the loading station. The corresponding complementary key (not shown) on the perimeter of the keyed opening 60 is a complementary protrusion into the opening 60. Visual markings, such as numbers, letters, logo, arrows and so forth, may also be present on a surface of the stick such that they draw attention to that surface and therefore serve to aid one in orienting the stick as it is viewed or held in the hand for identification or as it is loaded through an insertion opening. Visual markings may be any one or a combination of inset, protruding, laser or alternatively etched, imprinted or otherwise formed marks. The surface having such visual markings is usually, but not necessarily, considered the top surface of the ink stick. The surface considered to be the top surface may actually be oriented at any angular relationship relative to nominal horizontal, both as viewed exclusive of use or relationship to an imaging product and as inserted into an ink loader. The terms top and bottom encompass the case where one would otherwise be inclined to refer to these surfaces as front and back or ends, if the remaining surfaces are considered sides.

Although not depicted, the ink stick may include feeding features, such as alignment and guide elements, to aid in aligning and guiding ink sticks as they are moved along the feed channels to reduce the possibility of ink stick jams in the feed channel and to promote optimum engagement of the ink sticks with an ink melter in the ink melt assembly. Feeding features, therefore, may be substantially aligned with the feed direction F of the ink delivery system in order to interact with ink stick guides and/or supports in the ink delivery system. An ink stick may have any suitable number and/or placement of loading (i.e. insertion and/or feeding) features. Some of these features may be substantially perpendicular to one another, substantially aligned or have any other relationship.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key and/or sensing feature arrangement for ink sticks of each color. Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers.

Insertion and feeding features may provide a means of identification and/or authentication of an ink stick. For example, keying features of an ink stick interact with complementary shaped key elements in an insertion opening of the loading station to allow insertion of ink sticks having the appropriate key features and to exclude from insertion ink sticks that do not have the appropriate key features. Thus, insertion features and feeding features provide a physical means of identification and/or authentication of an ink stick, and, to a lesser extent, a visual means of identification if a printer user gains a familiarity with the keying configurations of ink sticks. Ink stick features provide a means of visually determining if sticks are identical or differentiating non identical sticks even when specific model or type identification is not recognized. Due to the soft, waxy nature of the ink stick body, however, ink sticks may be modified to include insertion features or feeding features that were not previously included in the ink stick by milling, cutting, melting and reforming, etc. If an ink stick that has been modified for insertion into a phase change ink imaging device which it was not originally intended for has not been optimized for use with or is not compatible with the imaging device, poor quality print jobs may result, and/or considerable errors and malfunctions may occur.

Figure 4:
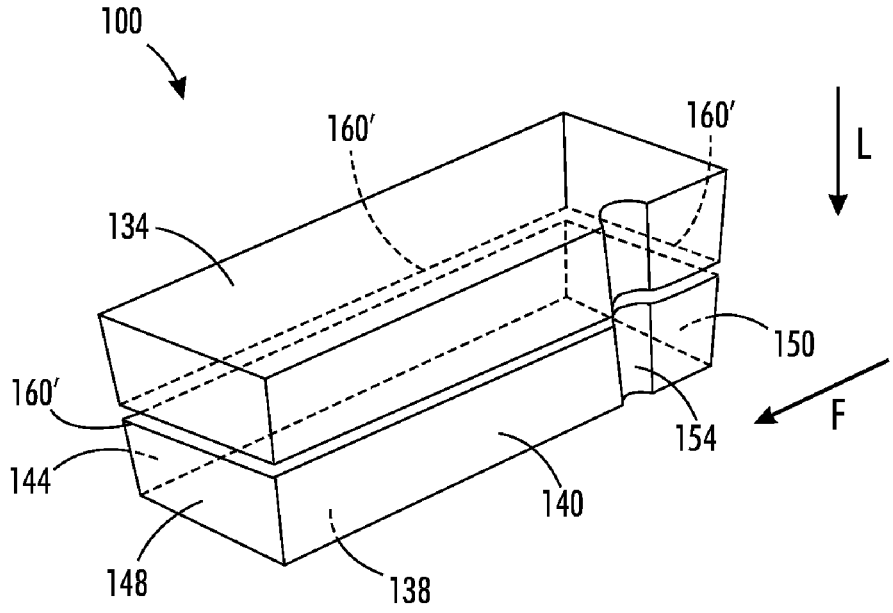
FIG. 4 is a perspective view of a solid ink stick that includes an alternative embodiment of a witness mark.

Visual inspections of previously known ink sticks may not be capable of detecting whether the ink sticks have been modified from a previous form. In order to provide visual indication of whether an ink stick has been modified, the ink stick of FIG. 3 includes a witness mark 160. A witness mark 160 comprises a line, groove, step, notch, bevel, inset, protrusion or other contrasting feature that extends along at least a portion of one or more surfaces, edges, or perimeter segments of the ink stick. Witness marks may be formed so that they follow the contour of key features that have been included in the ink stick. For example, as shown in FIGS. 3 and 4, the witness mark follows the interior contour of the key element of the ink stick. In addition, witness marks may be formed in positions that correspond to potential or possible key element locations. Possible key element locations on the ink stick comprise areas on the surface of the ink stick that are likely to be modified in order to add, remove, or otherwise reconfigure the keying configuration of the ink stick. The possible key element locations of the ink stick include an orientation at which the possible key elements may be placed. For example, any of the side surfaces 140, 144, 148, 150 of the ink stick of FIG. 3 may be modified to add additional insertion key elements that extend along the side surface between the top surface and the bottom surface of the ink stick substantially parallel to the insertion direction L.

In one embodiment, witness marks, such as the mark 160 of FIG. 3, are positioned on the ink stick so that they are transverse to the orientation of the possible key element locations. Because insertion keying elements may be added to an ink stick that extend along a surface of the ink stick in a direction that is substantially parallel to the insertion direction L, witness marks may be provided on the ink stick that extend transversely with respect to the insertion direction L. For example, the witness mark of FIG. 3 extends around the edge or perimeter of the ink stick in a direction that is transverse to the insertion direction L of the ink stick. The witness mark is substantially continuous along the entire perimeter, however, in alternative embodiments, witness marks may be extend along some but not all of the perimeter segments. Witness marks may be positioned to extend along any portion of substantially any surface of the ink stick including along an edge of a surface or any place between the edges of a surface. In the embodiment of FIG. 3, the witness mark extends along the edge or perimeter of the ink stick where the top surface and the respective side surfaces meet. FIG. 4 shows an alternative embodiment of ink stick in which a witness mark 160' is positioned on each side surface 140, 144, 148, 150 between the top 134 and bottom surface 138 of the ink stick substantially transverse to the insertion direction L of the ink stick.

Figure 5:
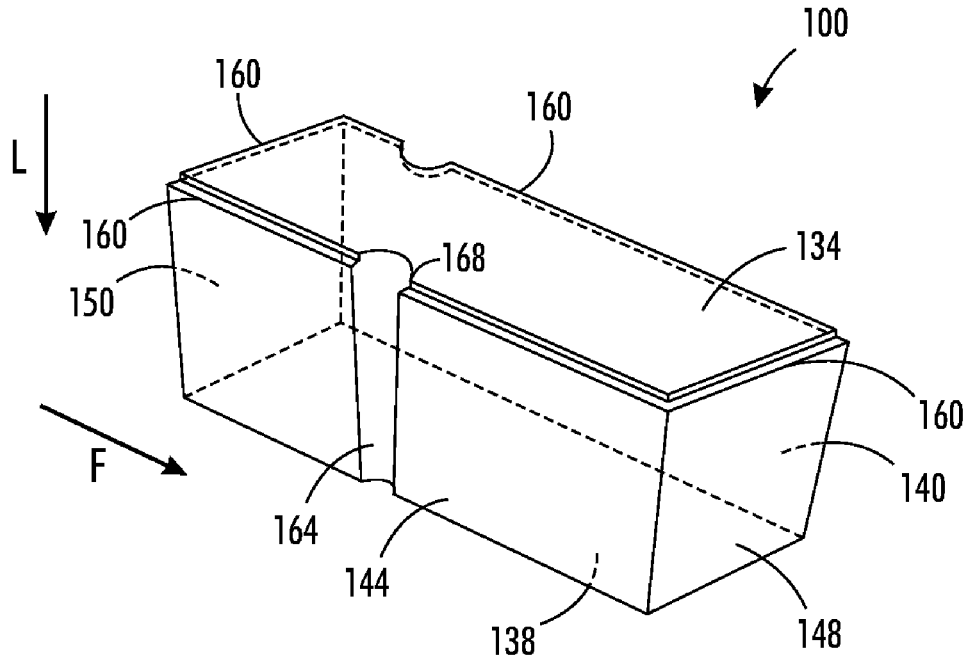
FIG. 5 is a perspective view of a solid ink stick with a witness mark in which the ink stick has been modified to include an additional key element.

Witness marks provide a visual indication of the authenticity of ink sticks. In particular, a subsequent alteration of the keying configuration of an ink stick may cause a break or interruption of the continuity of the witness mark thereby providing a visual indication of the modification to an individual such as a manufacturer's representatives, maintenance personnel, distributors, sales persons, purchasers, and end users. For example, FIG. 5 depicts an ink stick that has been altered to include an additional key feature 164 located in side 144 of the ink stick. As seen in FIG. 5, the continuity of the witness mark has been interrupted at location 168 by the incorporation of the key feature 164 into the ink stick. A visual inspection of the witness mark 160 by an individual allows a determination to be made whether the ink stick has been modified from the manufactured configuration.

The use of witness marks in an ink stick may also deter ink stick modification. For example, the dimensions of the witness mark may be "small" relative to the insertion and/or feeding features of an ink stick to increase the difficulty of replication. Therefore, while it may be possible to modify an ink stick to include the authentication feature, the additional cost and effort that may be required to modify an ink stick to include the witness mark may deter such modifications.

Figure 6:
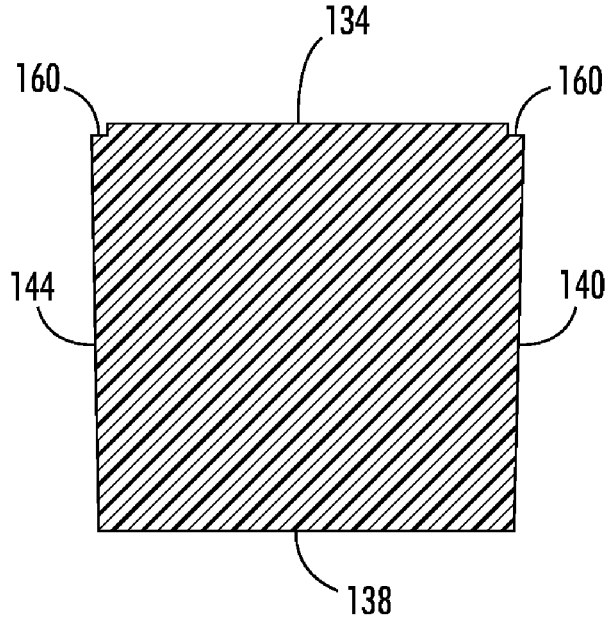
FIG. 6 is cross-sectional elevational view of an ink stick including a witness mark in the form of a step down height transition.
Figure 6A:
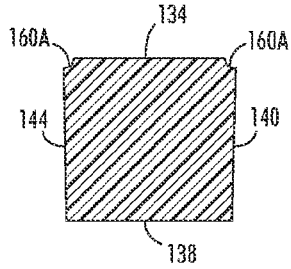
FIG. 6A is a cross-sectional elevational view of an ink stick including a witness mark in the form of a curved bevel.
Figure 6B:
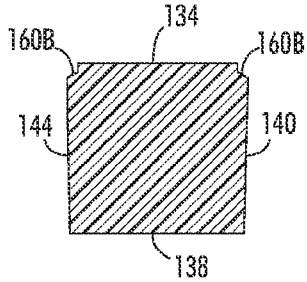
FIG. 6B is a cross-sectional elevational view of an ink stick including a witness mark in the form of a angled bevel.
Figure 6C:
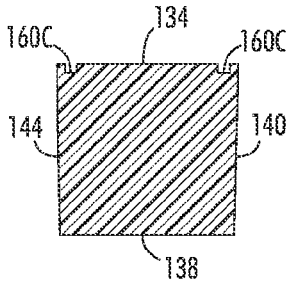
FIG. 6C is a cross-sectional elevational view of an ink stick including a witness mark in the form of an inset.
Figure 6D:
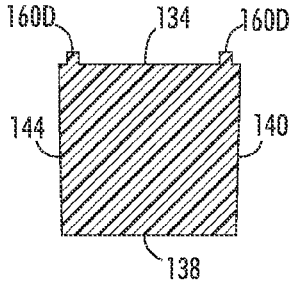
FIG. 6D is a cross-sectional elevational view of an ink stick including a witness mark in the form of a protrusion.
Figure 7:
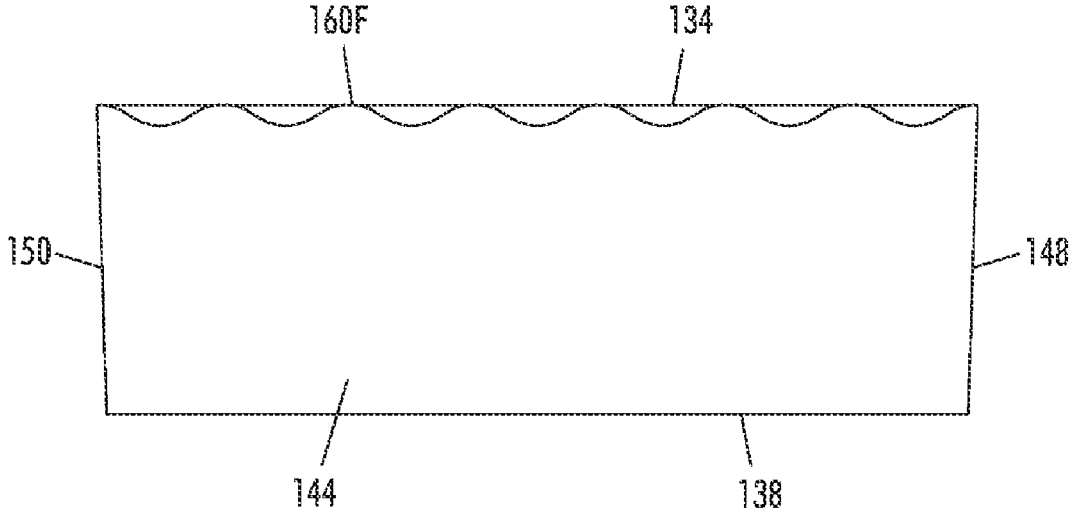
FIG. 7 is a side elevational view of an ink stick including a witness mark having a varying depth.

With reference to FIGS. 3 and 6, in one embodiment, the witness mark 160 comprises a step down height transition formed along the perimeter segments of the ink stick. Other features that are capable of providing a visual indication of ink stick modification may be used. FIGS. 6A-6D depict alternative embodiments of witness marks. For example, FIGS. 6A and 6B show embodiments of witness marks in the form of a curved bevel 160A (FIG. 6A) and an angled bevel 160B (FIG. 6B). FIGS. 6C and 6D depict witness marks in the form of an inset, or recess, 160C (FIG. 6C) or a protrusion 160D (FIG. 6D) that are adjacent the peripheral edge of the ink stick. Different forms of witness marks may be used on different portions of the perimeter of the ink stick. In addition, inset or protruding features of the witness marks may have constant and/or varying depths or heights. For example, FIG. 7 shows a side view of an embodiment of a witness mark 160F in which the witness mark has a varying depth.

Witness marks may be formed using any suitable method or device. As an example, witness marks may be incorporated in a known manner into the ink stick during molding of an ink stick. Alternatively, witness marks may be incorporated into ink sticks as part of a secondary process such as by laser cutting, heat or pressure forming, stamping, etc.

Figure 8:
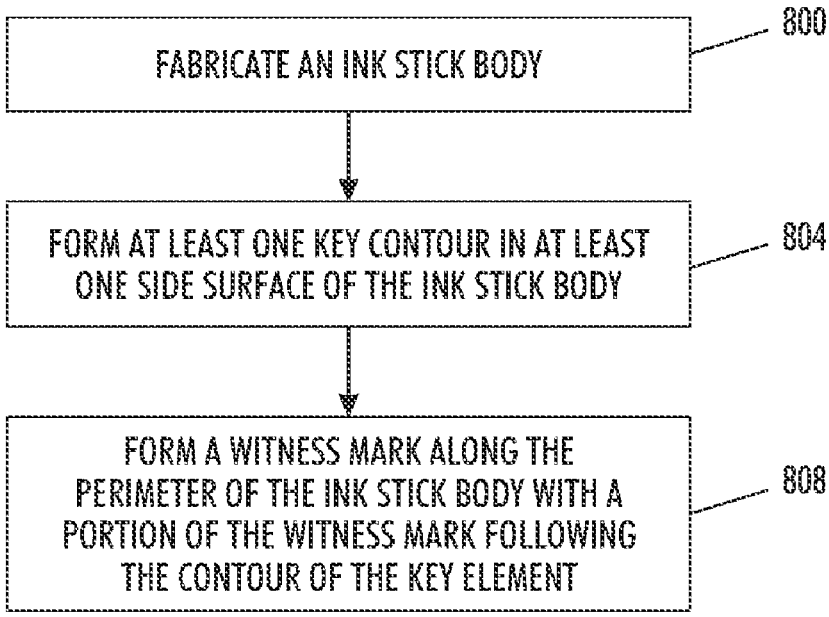
FIG. 8 is a flowchart of a method of manufacturing an ink stick with a witness mark.
Figure 9:
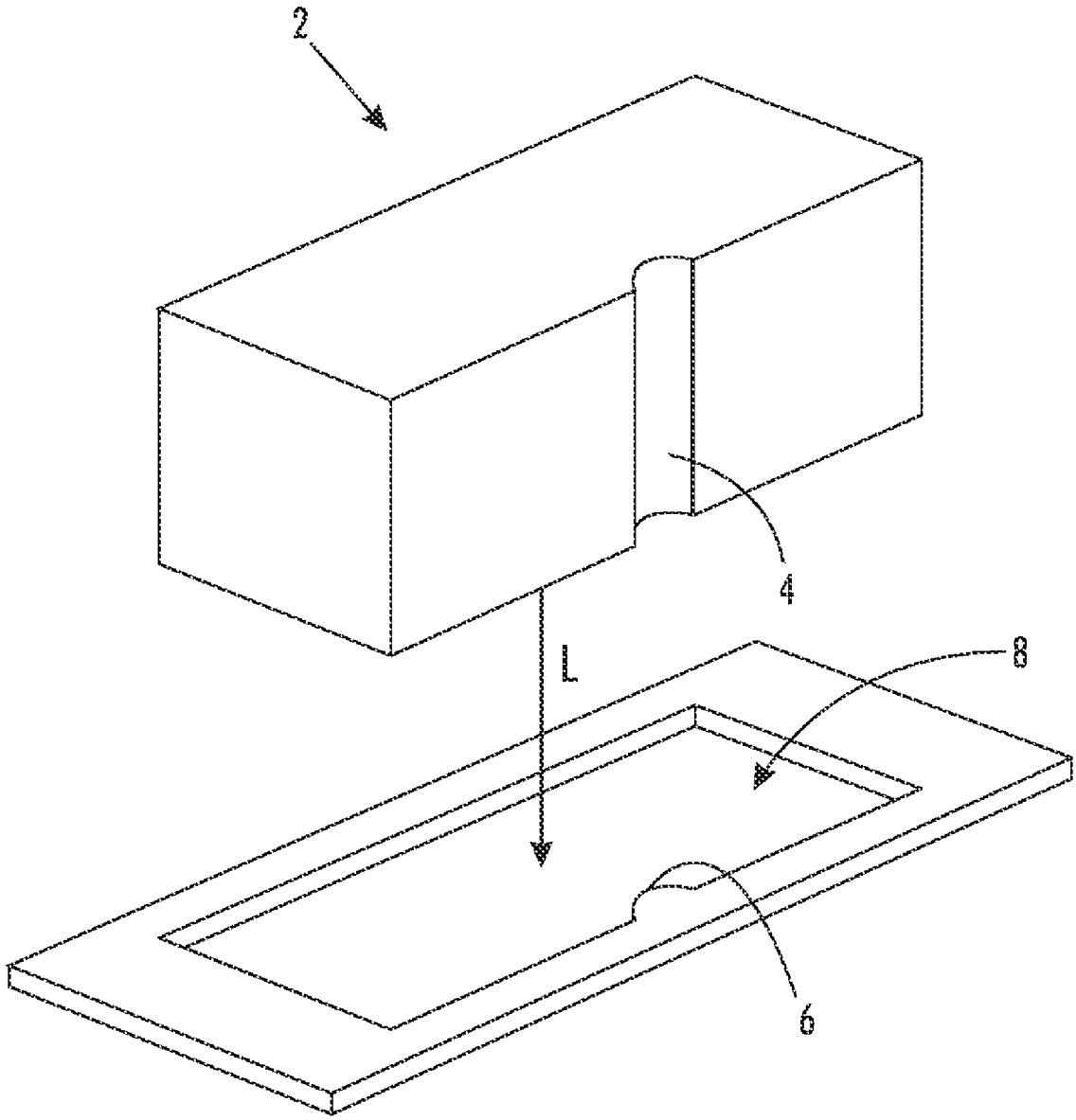
FIG. 9 depicts a prior art ink stick and a corresponding insertion opening of an ink loader.

FIG. 8 depicts a flowchart of a method of manufacturing an ink stick including a witness mark. The method comprises fabricating an ink stick body having a top surface, a bottom surface and a plurality of side surfaces extending between the top and bottom surfaces (block 800). The plurality of side surfaces defines a perimeter of the ink stick body. At least one key element or contour is then formed in at least one side surface of the ink stick body extending at least partially between the top surface and the bottom surface. (block 804). A witness mark is formed along at least a portion of the perimeter of the ink stick body with a portion of the witness mark following the at least one key contour. (block 808).

A witness mark may be incorporated into the ink stick during or after the ink stick keying configuration, including insertion and/or feeding features, has been formed. Forming key elements into the ink stick after formation of the witness mark requires the removal or addition of ink material in desired places on the ink stick thus providing a visual indication of the modification. For example, a recessed or inset key element formed in the ink stick may require removal or interruption of the witness mark. Similarly, if an ink stick that includes a witness mark is modified to remove a key element, e.g. "fill in" a recessed key element, the ink material that is placed in the recess of the key element covers the witness mark that follows the inner contour of the recessed key element. Thus, if the witness mark is interrupted by the inclusion of an additional key element or if the witness mark is "covered" by ink material in order to delete or alter a key element or if a key element is enlarged by removing material from the ink stick, the altered witness mark provides a visual indication of the modification.

Those skilled in the art will recognize that numerous modifications can be made to the specific implementations described above. For example, although the witness mark has been shown as being provided along the insertion perimeter of the ink stick, witness marks may be provided along the feed perimeter of the ink stick as an addition to or alternative to the insertion perimeter. Those skilled in the art will recognize that the witness mark may be formed in numerous shapes and configurations other than those illustrated. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A solid ink stick, the ink stick comprising:

an ink stick body having a top surface, a bottom surface and a plurality of side surfaces extending between the top and bottom surfaces, the plurality of side surfaces defining a perimeter of the ink stick body;

at least one key contour formed in at least one side surface in the plurality of side surfaces extending at least partially between the top surface and the bottom surface, the at least one key contour forming at least a portion of the perimeter of the ink stick body; and a witness mark formed along at least a portion of the perimeter of the ink stick body with a portion of the witness mark following the at least one key contour, the witness mark being at least partially inset into the perimeter of the ink stick body including the portion of the perimeter formed by the at least one key contour.

2. The ink stick of claim 1, the ink stick body being configured for insertion in an insertion direction through an insertion opening into an ink loader of a phase change ink imaging device, the ink stick body being configured to enable the bottom surface of the ink stick body to pass through the insertion opening of the ink loader first and the top surface of the ink stick body to pass through the insertion opening of the ink loader last.

3. The ink stick of claim 2, the perimeter of the ink stick body being positioned in a plane substantially perpendicular to the insertion direction, the witness mark extending along the side surfaces of the ink stick body to enable modification of the witness mark in response to the addition or deletion of a key contour in the solid ink stick body.

4. The ink stick of claim 3, the witness mark extending substantially continuously along the entire perimeter of the side surfaces of the solid ink stick body.

5. The ink stick of claim 1, the perimeter defined by the sides of the solid ink stick body corresponding to a visually recognized indicia, the visual recognized indicia being configured to identify the solid ink stick.

6. The ink stick of claim 5, the witness mark being formed along an edge joining the top surface to the plurality of side surfaces.

7. The ink stick of claim 6, the witness mark having a depth that extends towards an interior of the ink stick body, the depth of the witness mark varying along at least a portion of the witness mark.

8. An ink stick for use in an ink loader of a phase change ink imaging device, the ink stick comprising:

an ink stick body configured for insertion in an insertion direction into an ink loader of a phase change ink imaging device, the ink stick body including a top surface, a bottom surface and a plurality of side surfaces extending between the top and bottom surfaces that form an insertion perimeter of the solid ink stick body, the ink stick body being configured to enable the bottom surface of the ink stick body to enter an insertion opening in the ink loader before the top surface of the ink stick body enters the insertion opening as the ink stick body is inserted into the insertion opening of the ink loader in the insertion direction; and at least one key contour formed in the insertion perimeter of the ink stick body, the at least one key contour extending at least partially along at least one side surface in a direction substantially parallel to the insertion direction; and a witness mark formed in the insertion perimeter extending substantially continuously along the insertion perimeter of the ink stick body transverse to the insertion direction, a portion of the witness mark following the at least one key contour, the witness mark being at least partially inset into the insertion perimeter of the ink stick body including a portion of the insertion perimeter formed by the at least one key contour.

9. The ink stick of claim 8, the witness mark being formed along an edge that joins the top surface of the solid ink stick to the plurality of side surfaces.

10. The ink stick of claim 9, the witness mark having a depth that extends towards an interior of the ink stick body, the depth of the witness mark varying along at least a portion of the witness mark.

11. A method of fabricating an ink stick, the method comprising:

fabricating an ink stick body having a top surface, a bottom surface and a plurality of side surfaces extending between the top and bottom surfaces, the plurality of side surfaces defining a perimeter of the ink stick body;

forming at least one key contour in at least one side surface in the plurality of side surfaces extending at least partially between the top surface and the bottom surface, the at least one key contour forming at least a portion of the perimeter of the ink stick body; and forming a witness mark along at least a portion of the perimeter of the ink stick body with a portion of the witness mark following the at least one key contour, the witness mark being at least partially inset into the perimeter of the ink stick body including the portion of the perimeter formed by the at least one key contour.

12. The method of claim 11, the formation of the witness mark further comprising:

forming the witness mark using a secondary process after the fabrication of the ink stick body, the secondary process comprising at least one of laser cutting, heat forming, pressure forming, and stamping.

13. The method of claim 11, the formation of the witness mark further comprising:

forming the witness mark simultaneously with the fabrication of the ink stick.

* * * * *